US008047632B2

(12) United States Patent
Fujii et al.

(10) Patent No.: US 8,047,632 B2
(45) Date of Patent: Nov. 1, 2011

(54) INK JET RECORDING HEAD

(75) Inventors: Kenji Fujii, Kawasaki (JP); Yoshinori Tagawa, Yokohama (JP); Hiroyuki Murayama, Kawasaki (JP); Taichi Yonemoto, Isehara (JP); Mitsunori Toshishige, Kawasaki (JP); Keiji Watanabe, Kawasaki (JP)

(73) Assignee: Canon Kabushiki Kaisha, Toyko (JP)

( * ) Notice: Subject to any disclaimer, the term of this patent is extended or adjusted under 35 U.S.C. 154(b) by 337 days.

(21) Appl. No.: 12/394,939

(22) Filed: Feb. 27, 2009

(65) Prior Publication Data

US 2009/0225136 A1 Sep. 10, 2009

(30) Foreign Application Priority Data

Mar. 5, 2008 (JP) ..... 2008-054968

(51) Int. Cl.
*B41J 2/04* (2006.01)
*B41J 2/175* (2006.01)

(52) U.S. Cl. ..... 347/54; 347/85

(58) Field of Classification Search ..... 347/54, 347/56, 61, 62, 65, 85
See application file for complete search history.

(56) References Cited

U.S. PATENT DOCUMENTS

| | | | | |
|---|---|---|---|---|
| 6,918,657 | B2 | 7/2005 | Kawamura et al. | |
| 6,935,723 | B2 | 8/2005 | Murakami et al. | |
| 6,938,340 | B2 | 9/2005 | Haluzak et al. | |
| 7,287,847 | B2 | 10/2007 | Fujii et al. | |
| 7,300,596 | B2 | 11/2007 | Murayama et al. | |
| 2006/0017785 | A1 * | 1/2006 | Park et al. | 347/61 |
| 2007/0176990 | A1 | 8/2007 | Urayama et al. | |
| 2007/0252872 | A1 | 11/2007 | Fujii et al. | |
| 2009/0191487 | A1 | 7/2009 | Murayama et al. | |

FOREIGN PATENT DOCUMENTS

| | | |
|---|---|---|
| CN | 1724258 A | 1/2006 |
| JP | 2004-50794 | 2/2004 |

* cited by examiner

*Primary Examiner* — An Do
(74) *Attorney, Agent, or Firm* — Fitzpatrick, Cella, Harper & Scinto

(57) ABSTRACT

An ink jet recording head includes an ejection outlet for ejecting ink; an energy generating element, provided on a silicon substrate, for generating energy for ejecting the ink from the ejection outlet; an ink flow passage, provided correspondingly to the energy generating element, communicating with the ejection outlet; a through hole passing through the silicon substrate; and an ink supply port for supplying the ink supplied into the through hole to the ink flow passage. The ink supply port is formed with an extended member which contacts a bottom of a flow passage wall constituting the ink flow passage and extends into an opening of the through hole.

9 Claims, 3 Drawing Sheets

INK JET RECORDING HEAD

FIELD OF THE INVENTION AND RELATED ART

The present invention relates to an ink jet recording head for recording on various recording materials (media) such as paper, fiber, fabric, leather, metal, plastic, glass, wood, and ceramics.

In the ink jet recording head, a common ink supply port is formed by being penetrated through a substrate from the backside of the substrate and many nozzles are disposed on either one or both of lateral sides of an opening of the substrate to realize downsizing and image quality improvement.

For example, Japanese Laid-Open Patent Application No. 2004-50794 discloses a detailed nozzle structure. As a general nozzle structure, a through hole is provided as the common ink supply port and on both sides, energy generating elements for generating energy utilized for ejecting ink, individual ink flow passages, ejection outlets, nozzle filters, and the like are disposed in predetermined dimensions. Particularly, a wall constituting the individual ink flow passages is required to have a predetermined length on a surface of a silicon substrate in order to prevent an influence of pressure on an adjacent flow passage, i.e., a so-called cross-talk. Similarly, the nozzle filter is required to be disposed in a column shape on the surface of the silicon substrate with a predetermined size and a predetermined interval in order to prevent dust from being introduced into the ejection outlet portion. By using the nozzle filter, the dust introduction was prevented.

FIG. 7 is a partial top plan view of a conventional ink jet recording head. FIG. 8 is a sectional side view taken along a-a' line indicated in FIG. 7.

The ink jet recording head includes a silicon substrate 101 on which two arrays of energy generating elements are formed with a predetermined pitch. The silicon substrate 101 is provided with a through hole 113 which is formed by being penetrated through the silicon substrate 101 to open between the two arrays of the energy generating elements. The through hole 113 functions as a common ink supply port 117. On the silicon substrate 101, ejection outlets 111 opening above the respective energy generating elements by a second nozzle layer 109 and ink flow passages 118 establishing communication from the through hole 113 to the respective ejection outlets 111 are formed. Further, between the ink flow passages 118 and the common ink supply port 117, filters 115 are provided.

The ink jet recording head is disposed so that a surface at which the through hole 113 is formed as the common ink supply port 117 faces a recording surface of a recording material. Energy generated by the energy generating element 102 is applied to ink (liquid) filled in the ink flow passage 118 through the ink supply port 117 to eject ink droplets from the ejection outlet, so that the ink droplets are deposited on the recording material to carry out recording.

However, in the above-described ink jet recording head, an opening width of the common ink supply port 117 is determined by an opening width of the silicon substrate 101, i.e., an opening width of the through hole 113. By decreasing the opening width, the substrate can be downsized to result in a reduction in cost. However, when the through hole is formed, an etching technique is generally applied. However, through hole formation by etching causes variation attributable to various factors such as impurities of the substrate. Therefore, when a degree of the variation is taken into consideration, the above-described opening width cannot be much decreased.

Further, the flow passage and an area from an end portion of the flow passage to an end portion of the common ink supply port are required to have a length not less than a predetermined value in view of factors such as a fluid characteristic and cross talk. Therefore, there was a problem such that an area of the nozzle structure portion on the silicon substrate (from an end portion of a left hand ink flow passage 116 to an end portion of a right hand ink flow passage 116 between which the through hole 113 is sandwiched) cannot be narrowed. As a result, particularly, a degree of an influence of the problem on a chip provided with a plurality of common ink supply ports in one chip (substrate) was large, so that the problem was one of stumbling blocks for cost reduction. Further, with respect to the entire wafer, when an area per one chip is large, the number of available chips in the silicon substrate is decreased. As a result, it is difficult to realize the cost reduction.

SUMMARY OF THE INVENTION

A principal object of the present invention is to provide an ink jet recording head reduced in chip (substrate) size and cost without unnecessarily decreasing a dimension of a nozzle structure member such as an ink flow passage or a nozzle filter.

According to an aspect of the present invention, there is provided an ink jet recording head comprising:

an ejection outlet for ejecting ink;

an energy generating element, provided on a silicon substrate, for generating energy for ejecting the ink from the ejection outlet;

an ink flow passage, provided correspondingly to the energy generating element, communicating with the ejection outlet;

a through hole passing through the silicon substrate; and an ink supply port for supplying the ink supplied into the through hole to the ink flow passage, wherein the ink supply port is formed with an extended member which contacts a bottom of a flow passage wall constituting the ink flow passage and extends into an opening of the through hole.

According to the present invention, it is possible to reduce a size and cost of the ink jet recording head without unnecessarily decreasing the dimension of the nozzle structure member such as the ink flow passage or the nozzle filter.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings.

In the present invention, the term "recording" means not only that a significant image such as a character image or a graphical image is provided to the recording material but also that an insignificant image such as a pattern image is provided to the recording material.

Figure 1:
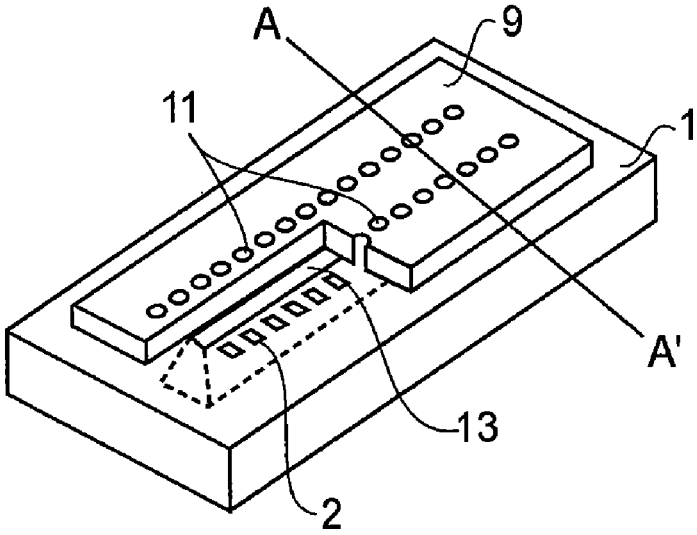
FIG. 1 is partially broken schematic perspective view of an embodiment of the ink jet recording head according to the present invention.

FIG. 1 is a partially broken schematic perspective view of an embodiment of an ink jet recording head of this embodiment.

Figure 2:
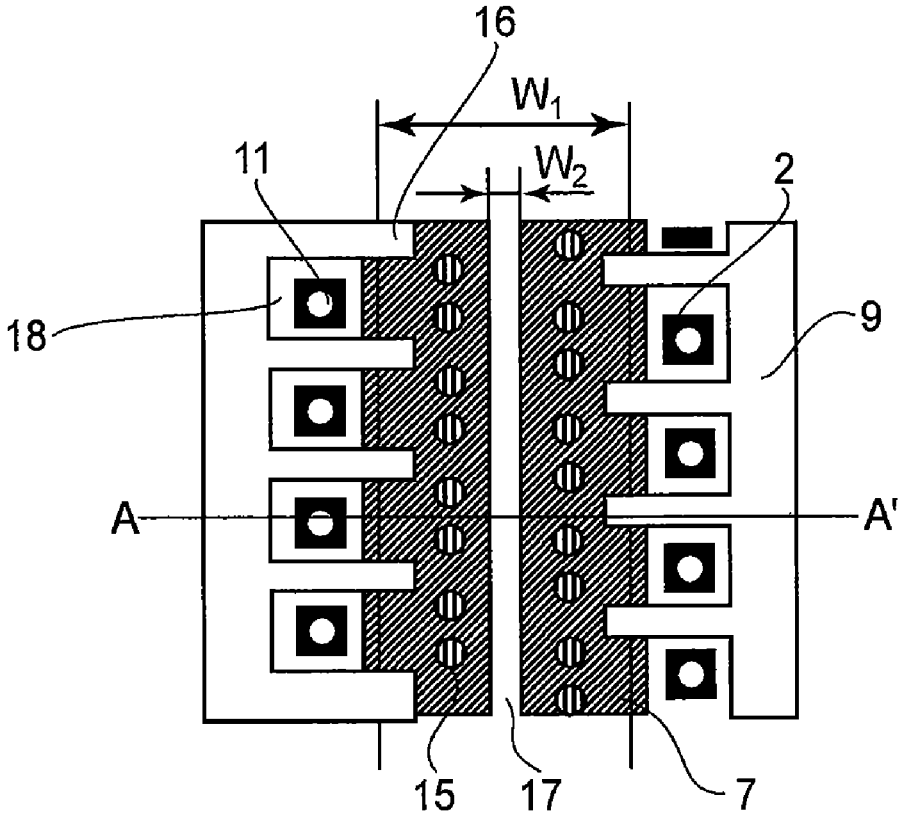
FIG. 2 is a schematic perspective top view of an ink jet recording head in Embodiment 1 of the present invention.

The ink jet recording head (liquid ejection head) of this embodiment includes a silicon substrate 1 on which two arrays of energy generating elements 2 for generating energy utilized for ejecting ink are formed with a predetermined pitch. The silicon substrate 1 is provided with a through hole 13 which opens between the two arrays of the energy generating elements 2. On the silicon substrate 1, ejection outlets 11 opening above the respective energy generating elements 2 by a second nozzle layer 9 and ink flow passages 18 establishing communication from the through hole 13 to the respective ejection outlets 11 are formed. The ink flow passages 18 formed by being partitioned by a wall 16 constituting the ink flow passages are individually provided correspondingly to the respective ejection outlets (FIG. 2).

This ink jet recording head is disposed so that a surface at which the through hole 13 is formed faces a recording surface of the recording material. A pressure generated by the energy generating element 2 for generating energy utilized for ejecting liquid is applied to ink (liquid) filled in the ink flow passage through the through hole 13 to eject ink droplets from the ejection outlet 11, so that the ink droplets are deposited on the recording material to carry out recording.

Embodiment 1

Embodiment 1 of the ink jet recording head according to the present invention will be described below.

Figure 3:
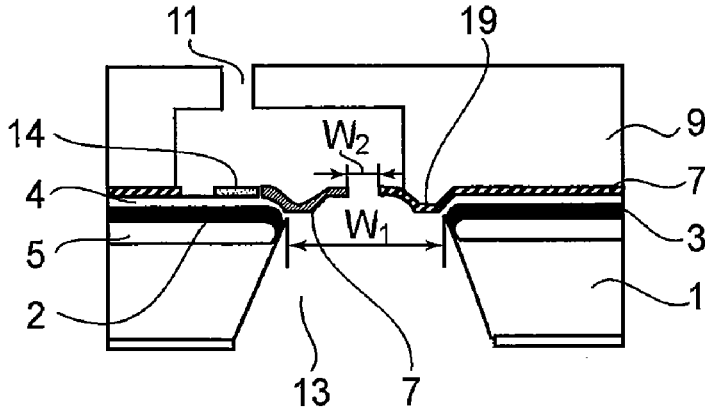
FIG. 3 is a schematic sectional view, of the ink jet recording head, taken along A-A' line indicated in FIGS. 1 and 2.

FIG. 2 is a schematic perspective top view of the ink jet recording head shown in FIG. 1. FIG. 3 is a schematic sectional view taken along A-A' line indicated in FIGS. 1 and 2.

In the ink jet recording head of this embodiment, one heat generating element is formed for each of flow passages to make recording.

On the silicon substrate 1, a thermal oxidation film 5 as an insulating layer, a silicon oxide film 3, the energy generating elements 2, a silicon nitride film 4, and an anti-cavitation film 14 are formed. The silicon substrate 1 is provided with the through hole 3. Electric wiring or the like is omitted from illustration in the figures. The respective thin films such as the thermal oxidation film 5, the silicon oxide film 3, the silicon nitride film 4, and the anti-cavitation film are all patterned in predetermined shapes by using a photolithographic technique. The through hole 3 is formable by using various lasers or an anisotropic etching technique.

Next, a nozzle structure will be described with reference to FIG. 3 showing an example of the nozzle structure.

On the silicon nitride film 4, an adhesiveness improving layer 7 for improving adhesiveness to the second nozzle layer 9 is patterned in a predetermined shape. The adhesiveness improving layer 7 is subjected to patterning so as to have such a shape that the adhesiveness improving layer 7 extends into an opening of the through hole 13. The adhesiveness improving layer 7 extends into the opening of the through hole 13 as an extended member, so that an opening width $W_1$ on the substrate side of the silicon substrate 1 is narrowed to an opening width $W_2$ by the adhesiveness improving layer 7. That is, the opening width of a common ink supply port 17 is constituted as the opening width $W_2$ narrower than the opening width $W_1$. Therefore, the ink supplied into the through hole 13 is guided to the ink flow passages 18 through the common ink supply port 17. The common ink supply port 17 is formed by the adhesiveness improving layer 7 extending toward the through hole 13 side.

In this embodiment, as the adhesiveness improving layer 7, a polyetheramide resin material which is an organic resin material was used. Specifically, a material ("HIMAL-1200", mfd. by Hitachi Chemical Co., Ltd.) was used. With respect to a (film) thickness of the adhesiveness improving layer 7, such a thickness that the adhesiveness improving layer 7 is not broken by ink ejection or the like is required at a minimum level but an excessive thick adhesiveness improving layer lowers a refilling property. For this reason, the thickness of the adhesiveness improving layer 7 should be set in consideration of a balance between a material strength and the refilling property. As a result, the thickness of the adhesiveness improving layer 7 was set at 2 μm. A bottom of a ink flow passage wall 16 is brought into contact with the adhesiveness improving layer 7 as the extended member extended onto the opening of the through hole 13. That is, on the silicon substrate 1 on which the adhesiveness improving layer 7 is disposed, the second nozzle layer 9 including the ink flow passages is patterned in a predetermined shape by using a mold material. As shown in FIG. 2, part of the ink flow passage wall 16 is present in the opening of the silicon substrate. As a result, while the ink flow passage wall 16 ensures a necessary length, the adhesiveness improving layer 7 is present on the through hole 13, so that it is possible to bring the entire nozzle structure including the energy generating elements 2 near to the through hole 13.

As a specific dimension, in the case of a constitution in which the adhesiveness improving layer 7 was not present on the through hole, a distance from a center of the opening width of the common ink supply port 17 to an end portion of the energy generating elements 2 was 127 μm. On the other hand, by employing such a constitution that the adhesiveness improving layer 7 was present on the through hole 13 as in this embodiment, it was possible to decrease the distance to 85 μm.

By employing the constitution of this embodiment, it is possible to narrow an area of the nozzle structure portion on the silicon substrate 1 while the nozzle structure capable of providing a good ejection property is substantially retained. Further, the opening width $W_1$ on the silicon substrate surface side can be sufficiently ensured, so that a yield is not worsened compared with a conventional constitution even when the through hole is formed by the anisotropic etching or the like.

Further, in this embodiment, a portion at which the energy generating elements are formed may preferably be formed on the silicon substrate in view of the influences of pressure and heat during drive of the energy generating elements. Part of the end portion of the wall 16 for forming the flow passages may preferably be provided to an extended portion of the extended member as described above. Further, from the viewpoint of ensuring of a strength of the extended portion, as shown in FIG. 3, a stepped portion 19 (bent portion) may preferably be provided to the extended portion.

Further, it is also possible to provide a nozzle filter 15 so as to contact, at its bottom, the adhesiveness improving layer 7 which is the extended member extending into the opening of the through hole 13. That is, in the ink jet recording head of this embodiment, the nozzle filter 15 as a filter for preventing foreign matter introduction into the ink flow passage 18 can also be provided on the adhesiveness improving layer 7 extended into the through hole 13 side. As a result, the ink jet recording head of this embodiment is suitably employed from the viewpoint that a head having the filtering function can be provided on a smaller substrate.

In this embodiment, such a constitution that the part of the bottom of the ink flow passage wall 16 and the bottom of the nozzle filter 15 contact the adhesiveness improving layer 7 at a portion located between an end of the through hole 13 with the opening width $W_1$ and an end of the common ink supply port 17 with the opening width $W_2$ was illustrated. However, the present invention is not limited to such a constitution but the ink jet recording head of the present invention may also have a constitution in which the nozzle filter 15 is not employed and only the bottom of the ink flow passage wall 16 contacts the adhesiveness improving layer 7. The constitution in which both of the ink flow passage wall 16 and the nozzle filter 15 contact the adhesiveness improving layer 7 is desirable since the resultant nozzle structure is strengthened and a function of preventing the foreign matter from reaching the ejection outlet is performed.

As described above, according to this embodiment, it is possible to considerably narrow the distance between the energy generating elements present on both sides of the common ink supply port 17 without necessarily increasing the dimension of the nozzle structure members such as the ink flow passages 18 and the nozzle filters 15. As a result, with respect to a chip in which many common ink supply ports 17 were present, it was possible to reduce a chip size by two times the number of the common ink supply ports 17 (i.e., by providing the energy generating elements on both sides of each common ink supply port). Further, also with respect to the entire wafer, an area per one chip was decreased, so that it was possible to increase the number of available chips in the silicon substrate. Further, the opening width $W_1$ of the through hole 13 is retained as before, so that it is possible to suppress a lowering in yield of a manufacturing step. Thus, according to this embodiment, it is possible to reduce the manufacturing cost per one chip.

Incidentally, the above-described thickness value of the adhesiveness improving layer 7 is merely a reference value for describing this embodiment and therefore the present invention is not limited to the thickness value.

Embodiment 2

Figure 4:
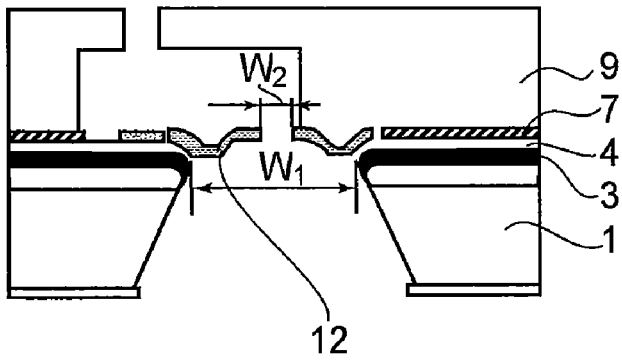
FIG. 4 is a schematic sectional view of an ink jet recording head in Embodiment 2 of the present invention.

FIG. 4 is a schematic sectional side view of an ink jet recording head of this embodiment. This embodiment basically has, as described below, the same constitution as that of Embodiment 1 except that the first nozzle layer 12 is used in place of the adhesiveness improving layer 7 as the extended member extending into the opening of the through hole 13. Therefore, a similar constitution will be omitted from description. Further, constituent elements or members identical to those in Embodiment 1 are represented by identical reference numerals or symbols.

In the ink jet recording head of this embodiment, on the silicon nitride film 4, the adhesiveness improving layer 7 and the first nozzle layer 12 are patterned in predetermined shapes. The first nozzle layer 12 is subjected to patterning so as to provide such a shape that the opening width $W_1$ of the through hole 13 on the surface side of the silicon substrate 1 is narrowed to the opening width $W_2$. That is, in Embodiment 1, the adhesiveness improving layer 7 is formed by being extended onto the through hole 13 to narrow the opening width. On the other hand, in this embodiment, the opening width is narrowed by the first nozzle layer 12.

In this embodiment, as a material for the first nozzle layer 12, the same photosensitive epoxy resin material as that for the second nozzle layer 9 was used. By employing the same material for the first nozzle layer 12 and the second nozzle layer 9, it is not necessary to consider spending on new plant and equipment, so that an increase in cost of the first nozzle layer 12 can be prevented.

Incidentally, as the first nozzle layer 12, a required function is satisfied if the material has an anti-ink property, so that a similar function can be performed by not only the photosensitive epoxy resin material as the nozzle layer material but also an inorganic material such as a gold-plated material, tantalum, or silicon nitride can have a similar function. However, this material is used or the extended member extended into the opening of the through hole 13, so that a strength of the extended portion is required. Therefore, it can be said that an organic material high in tensile strength is more desirable than the inorganic material. The thickness of the first nozzle layer 12 was set at 2 μm in consideration of the balance between the material strength and the refilling property.

According to this embodiment, similarly as in Embodiment 1, the distance from the center of the common ink supply port 17 to the end portion of the energy generating element 2 can be shortened, so that the ink jet recording head can be downsized.

Embodiment 3

Figure 5:
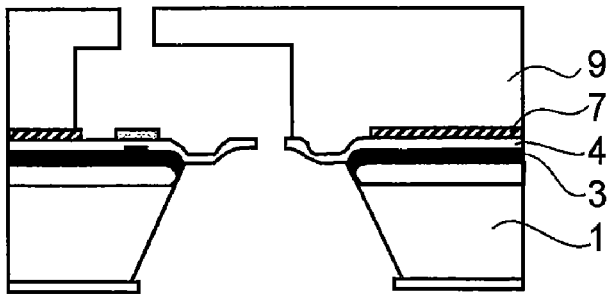
FIG. 5 is a schematic sectional view of an embodiment of an ink jet recording head in Embodiment 3 of the present invention.
Figure 6:
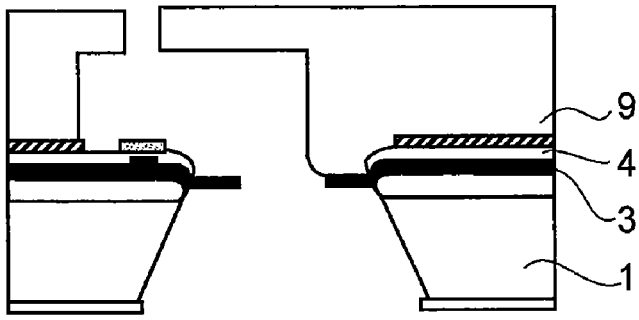
FIG. 6 is a schematic sectional view of another variation of the ink jet recording head in Embodiment 3 of the present invention.
Figure 7:
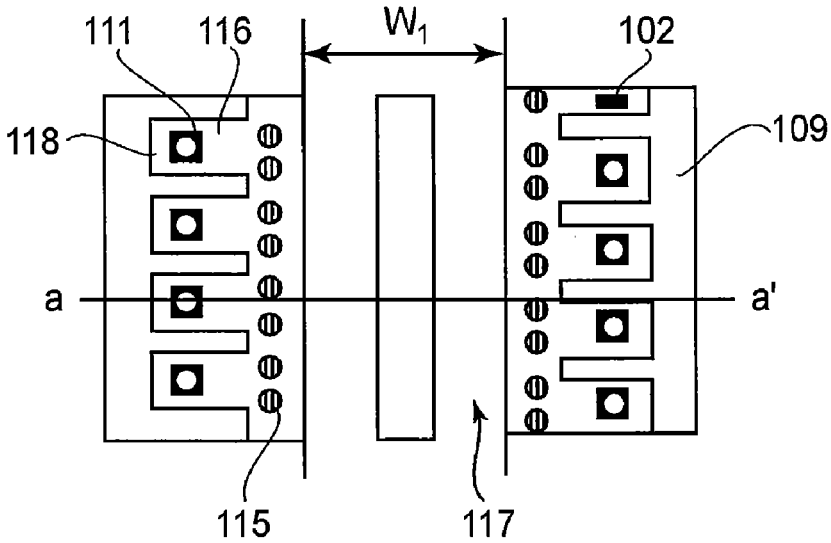
FIG. 7 is a schematic perspective top view of an embodiment of a conventional ink jet recording head.
Figure 8:
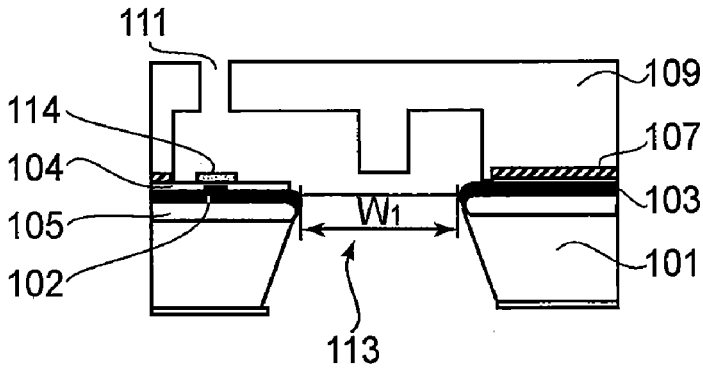
FIG. 8 is a schematic sectional side view, of the conventional ink jet recording head, taken along a-a' line indicated in FIG. 7.

FIGS. 5 and 6 are schematic sectional side views of ink jet recording heads of this embodiment. This embodiment basically has, as described below, the same constitution as that of Embodiment 1 except that the silicon oxide film 3 or the silicon nitride film 4 is used in place of the adhesiveness improving layer 7 in Embodiment 1 as the extended member extending into the opening of the through hole 13. Therefore, a similar constitution will be omitted from description. Further, constituent elements or members identical to those in Embodiment 1 are represented by identical reference numerals or symbols.

This embodiment is characterized by a constitution of the silicon substrate 1. This constitution can be provided by forming the silicon oxide film 3 or the silicon nitride film 4 in a predetermined pattern in advance. Further, the material for the extended member extended onto the through hole 13 may also be those containing a material, used for electric wiring, such as silicon carbide.

In addition to the above-described materials in the respective embodiments, as the material for the extended member, it is also possible to use a thermoplastic resin material. Further, in the present invention, it is also possible to appropriately combine the constitutions in the respective embodiments described above.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 054968/2008 filed Mar. 5, 2008, which is hereby incorporated by reference herein.

What is claimed is:

1. An ink jet recording head comprising:

a plurality of ejection outlets for ejecting ink;

a plurality of energy generating elements, provided on a silicon substrate, for generating energy for ejecting the ink from said ejection outlets;

a plurality of ink flow passages, provided correspondingly to said energy generating elements, communicating with said ejection outlets;

a through-hole passing through the silicon substrate, wherein said through-hole extends from one longitudinal end side to the other longitudinal end side of the silicon substrate and supplies the ink to said plurality of ink flow passages; and an ink supply port for supplying the ink supplied into said through-hole to said ink flow passages, wherein said ink supply port is provided correspondingly to said through-hole and extends from the one longitudinal end side to the other end side of the silicon substrate, wherein said ink supply port is formed with an extended member which contacts a bottom of a wall constituting said plurality of ink flow passages and extends into an opening of said through-hole, and wherein the wall partitions said plurality of ink flow passages and extends in a direction crossing a direction in which said ink supply port extends.

2. A head according to claim 1, wherein said extended member contacts a bottom of a nozzle filter for preventing foreign matter introduction into said ink flow passages.

3. A head according to claim 1, wherein said extended member is formed of an organic resin material.

4. A head according to claim 3, wherein the organic resin material is an epoxy resin material.

5. A head according to claim 1, wherein said extended member is formed of a thermoplastic resin material.

6. A head according to claim 1, wherein said extended member comprises an adhesiveness improving layer formed on the silicon substrate.

7. A head according to claim 1, wherein said extended member comprises a silicon nitride film formed on the silicon substrate or a silicon oxide film formed on the silicon substrate.

8. A head according to claim 1, wherein said extended member is formed of a material identical to a material for a nozzle layer formed on the silicon substrate.

9. A head according to claim 1, wherein said extended member which extends into the opening of the through-hole is provided with a stepped portion.

* * * * *